US005209521A

United States Patent [19]

Osborne

[11] Patent Number: 5,209,521

[45] Date of Patent: May 11, 1993

[54] EXPANDING LOAD SHOULDER

[75] Inventor: Roger S. Osborne, Houston, Tex.

[73] Assignee: Cooper Industries, Inc., Houston, Tex.

[21] Appl. No.: 894,176

[22] Filed: Jun. 3, 1992

Related U.S. Application Data

[63] Continuation of Ser. No. 647,672, Jan. 24, 1991, abandoned, which is a continuation of Ser. No. 371,741, Jun. 26, 1989, abandoned.

[51] Int. Cl.[5] ..... F16L 35/00

[52] U.S. Cl. ..... 285/3; 285/133.2; 285/141

[58] Field of Search ..... 285/3, 4, 141, 133.2, 285/321

[56] References Cited

U.S. PATENT DOCUMENTS

| | | | |
|---|---|---|---|
| 2,086,431 | 7/1937 | Penick et al. | 285/141 |
| 2,328,840 | 9/1943 | O'Leary | 285/3 X |
| 4,528,738 | 7/1985 | Galle, Jr. | 285/141 X |
| 4,550,782 | 11/1985 | Lawson | 285/141 X |
| 4,641,708 | 2/1987 | Wightman | 285/141 X |
| 4,651,830 | 3/1987 | Crotwell | 285/141 X |

*Primary Examiner*—Dave W. Arola
*Attorney, Agent, or Firm*—William E. Shull; David A. Rose; Ned L. Conley

[57] ABSTRACT

A self-actuating, releasable weight support system includes a structural support member with a central bore therethrough. The bore has a recessed load support surface therein and a no-go shoulder on the inner periphery of the load support surface. A weight support member is insertable within the bore, and includes an expandable load ring disposed thereon for landing on the no-go shoulder and expanding onto the load support surface as the weight support member is inserted further into the bore.

11 Claims, 2 Drawing Sheets

EXPANDING LOAD SHOULDER

This is a continuation of copending application Ser. No. 07/647,672 filed on Jan. 24, 1991 and now abandoned.

BACKGROUND OF THE INVENTION

The present invention relates generally to wellhead equipment for use in completion of oil or gas wells, and more particularly to an expandable load ring carried by an annular weight support member for expansion into a recessed load support groove in a surrounding structural support member. The weight support member may be, for example, a casing hanger, and the surrounding structural support member may be, for example, a casing head.

In the modern-day completion of conventional oil or gas wells, it is not uncommon for the casing program to include several strings of intermediate casing between the oil string casing and the surface or conductor casing, as well as one or more tubing strings. Typically, the surface or conductor casing is first run and cemented in the well bore, and the lowermost or surface casing head mounted on its upper end. Drilling then continues and an additional casing head is installed. The casing is set in a hole drilled at the rig, and a blowout preventer, or BOP, is located over the casing and hole being drilled. Installation of each additional casing head requires the removal of the blowout preventer. Then, after all casings are in place, a similar procedure is followed for the tubing head and tubing strings. Usually, the casing strings are each suspended from hanger equipment supported in a separate casing head. Similarly, the tubing strings are usually supported in a separate tubing head.

Installing separate heads for each casing string after the surface casing is installed is time-consuming, expensive, and potentially very dangerous. Each time a new casing head is installed on top of the wellhead equipment already present, the blowout preventer equipment must be removed. Typically, the blowout preventer stack is lifted and suspended while rig operators, working under it, install the new head. Since the BOP stack can weigh fifty tons or more, an accident or equipment malfunction or failure while the stack is suspended, causing partial or complete collapse of the stack, can cause serious injury or death to operators, as well as costly damage to equipment and lost rig time. When the new head has been installed and the BOP stack lowered for reinstallation, or another size or type of BOP equipment is installed to accommodate larger casing hangers, that too can be a dangerous and costly operation, especially if an equipment malfunction or failure were to occur. Operators exhibiting less than complete care and attention have lost fingers or hands during the BOP stack reinstallation operation, even when all equipment operates normally and as expected. The hazards inherent in working with equipment of this size and weight are amplified by the non-ideal working conditions on the rig; equipment, rig structure, and personnel are frequently covered by oil, grease, mud, or the like.

In addition to exposing operators to the dangers of mishandled equipment and accidents, removal of the BOP stack to install a new head is inherently dangerous, since during that time the well, and consequently the rig and operators, are unprotected against potentially catastrophic blowouts.

At best, when all equipment operates normally and without any accidents or the like, installation of a new head with BOP stack removal and reinstallation can take anywhere from about four to about twelve hours. For highly expensive rig crews and equipment, this operation can thus amount to a prohibitive expense.

In order to avoid some of the dangers and expense of installing a separate casing head for each casing, sometimes casing heads are used which can accommodate more than one casing string. This is sometimes done by providing the head with two annular support shoulders, with the larger ID shoulder simply being stepped back from the smaller one. The first casing is hung from the lower end of the casing head, and the second casing slides through the first casing, but has a larger flange which rests in the casing head above the first casing hanger. A separate casing hanger rests on each shoulder, suspending casing therefrom. With conventional heads of this type having a plurality of stepped-back annular shoulders, however, it is very difficult, if not entirely impossible, to provide for more than two such annular support shoulders while remaining within API requirements for the minimum shoulder bearing areas for the flange sizes of the hangers to be supported thereon. For any casing head, the minimum ID permissible in the casing head bore will be determined by the OD of the largest casing suspended from the bottom of the head. Thus, the total bearing area available for stepped-back annular support shoulders in conventional heads will be limited by this minimum head ID. The minimum bearing area for each annular support shoulder is determined such that it will be capable of supporting not only the weight of the hanger and its suspended casing, but also any load applied to the hanger's cross-sectional area from internal wellhead pressures. As hanger flange sizes increase for smaller diameter casings suspended above the lowermost casing, the potential pressure load increases, without regard to whether the suspended casing weight for the smaller casings might be less than the larger. Therefore, the minimum bearing area required for support shoulders for smaller casings will still be substantial, in order to support expected string weights and pressure loads.

There simply is not enough available bearing area in conventional heads for three or more stepped-back annular shoulders while remaining within API requirements; if three or more such shoulders are provided, one or more of them will not have the minimum specified bearing area for hangers of that flange size. In addition, for conventional heads as just described, as larger flange sizes are provided for the hangers to suspend smaller casing strings, it becomes more difficult, if not impossible, to run such hangers through the often restricted bores of the blowout preventer equipment mounted above the head. Accordingly, even if three or more annular stepped-back support shoulders were to be provided in the head, the conventional hangers for the smaller casing strings probably could not be run through the BOP stack, thereby necessitating BOP stack removal and eliminating the advantages of suspending the third and smaller strings from the same head in the first place.

Another approach to providing a multi-string head which has met with some success in the oil and gas industry is exemplified by the so-called "speed head" and hanger apparatus described, for example, in U.S. Pat. No. 3,438,654, issued Apr. 15, 1969, to J. G. Jackson, Jr., et al. While head and hanger equipment of that type is capable of suspending a plurality of casing and tubing strings from a single head, such equipment is inordinately complex, difficult to manufacture and relatively difficult to install, and expensive. Yet another approach to a multi-string head which has met with some success is the split load shoulder, such as one offered by Gray Tool Company, for example. The split load shoulder is typically a hinged circular ring which is installed in the head in expanded condition, and is actuated by a crank handle mounted on the outside of the head. Rotation of the crank handle reduces the ID of the split load shoulder, providing the required bearing area. Although probably less complicated than the speed head and hanger, the split load shoulder and accompanying head is still a more complex, expensive, and difficult system to manufacture and install than that of the present invention. Yet another multi-string system which has been proposed is the new "Cam Forge" system offered by Cameron Iron Works, which, although not known to be prior art with respect to the present invention, is believed to include a support ring which is forced into a groove in the head in a separate operation by a special tool. Again, such a system is less advantageous than the present invention, which does not require any special tools or operations to run and set the hangers in the accompanying head.

SUMMARY OF THE INVENTION

The present invention overcomes the problems associated with the prior art systems and devices and other alternative design approaches described or referred to above by providing a head and hanger apparatus capable of accommodating three or more casing strings and which is simple, reliable, easy to manufacture, run, and install, and inexpensive. The apparatus of the present invention includes an expandable, C-shaped load ring mounted on a hanger and retained thereon by a retainer ring. A fracturable cupon disposed between the ends of the load ring, or a plurality of such cupons disposed between the load ring and the retainer ring and circumferentially spaced apart about their outer peripheries, maintains the load ring in a contracted position until actuated. A recessed, annular support groove in the wall of the head has a no-go shoulder below the lower edge of the recessed groove upon which the expandable load ring lands when the hanger is lowered into the head. The weight of the casing string suspended by the hanger is applied to the load ring and is sufficient to fracture the cupon or cupons. With the cupon or cupons fractured, the load ring is free to expand into the recessed groove above the no-go shoulder. The hanger body above the load ring is provided with a frustoconical camming surface which cams the load ring outwardly into the recessed groove as the hanger continues its downward movement in the head. When the load ring is fully cammed into the groove, an annular shoulder on ring, and downward movement of the hanger stops. The hanger and casing string attached thereto are thus suspended from the recessed groove, through the expanded load ring. The load ring and recessed groove have sufficient contact or bearing area to support the casing and hanger weight, and the loads applied by internal wellhead pressures. The complete expansion of the load ring is effected within its elastic limits, so that if it becomes necessary to remove the hanger from the head it can simply be lifted straight up, and the C-shaped load ring will collapse back into a non-actuated, contracted state. To facilitate such collapse, the upper outer edge of the load ring is chamfered, and the roof or upper wall surface of the recessed groove is correlatively frustoconical-shaped, so that when the load ring is lifted upwardly these two surfaces will engage one another and tend to cam the load ring into the collapsed state.

The head according to the present invention may be provided with three or more recessed grooves for supporting three or more casing strings, while at the same time assuring that API requirements for minimum bearing areas will be met. The recessed shoulders need only be stepped back from one another, moving from the lowermost groove upwardly in the head, a distance sufficient to provide the next or subsequent no-go shoulder upon which the next or subsequent load ring lands and which begins the actuation of that next load ring. The no-go shoulder needs only to be large enough to support the weight necessary to fracture the cupon or cupons; after that happens, the recessed groove as a whole becomes the support surface as the load ring is cammed into it. It is believed that a setback of only about one-eighth inch from one recessed groove to the next higher groove will provide the necessary no-go shoulder for that next higher groove.

Moreover, since the load rings of the present invention are run into the head in contracted positions, the hangers carrying such load rings may be run through relatively restricted bores in the blowout preventer equipment, avoiding the need for removing the BOP stack from time to time to suspend the multiple casing strings. That is, greater weight support equipment may be run through a given size BOP stack or other restricted bore.

BRIEF DESCRIPTION OF THE DRAWINGS

These and other advantages of the present invention will be apparent from the following detailed description, taking into account the foregoing discussion, and read in conjunction with reference to the following drawings wherein.

DETAILED DESCRIPTION OF THE PREFERRED EMBODIMENT OF THE INVENTION

Figure 1:
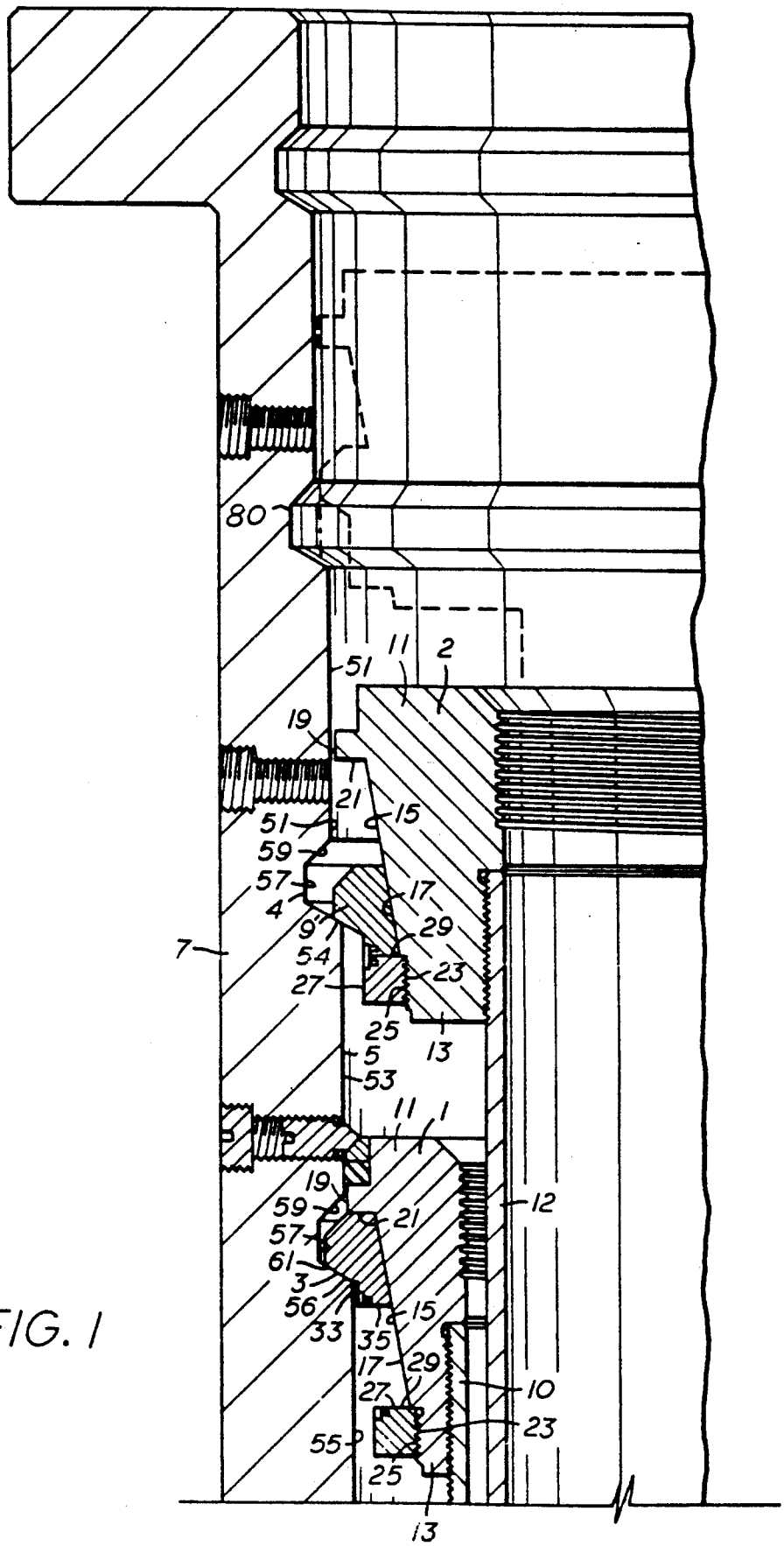
FIG. 1 is a fragmentary cross-sectional view of a wellhead employing expandable load rings according to the present invention.

Referring to FIG. 1, there is shown in a fragmentary, cross-sectional configuration two annular weight support members 1, 2. Weight support members 1, 2 may be, for example, casing hangers to which are attached casing strings (not shown) which are to be suspended in an oil or gas well. Weight support members or hangers 1, 2 are shown suspended from annular, recessed load support grooves 3, 4 in the wall 5 of a surrounding structural support member 7. Structural support member 7 may be, for example, a casing head for such an oil or gas well. Although it should be understood that members 1, 2 and 7 may be any type of apparatus wherein members 1 and 2 are to be suspended inside member 7, the present invention has particular utility with respect to casing hangers in oil or gas well heads, and for the sake of convenience and clarity the invention will be described hereinafter with regard to that particular environment. Accordingly, such members 1, 2 and 7 will hereinafter be referred to as hangers 1, 2 and head 7. Hanger 1 is suspended from groove 3 through an expandable load ring 9 mounted on hanger 1. Likewise, hanger 2 is suspended from groove 4 through an expandable load ring 9' mounted on hanger 2. For ease of reference, only hanger 1 will be described in detail. The details of hangers 1, 2 are identical, except where otherwise described.

Figure 2:
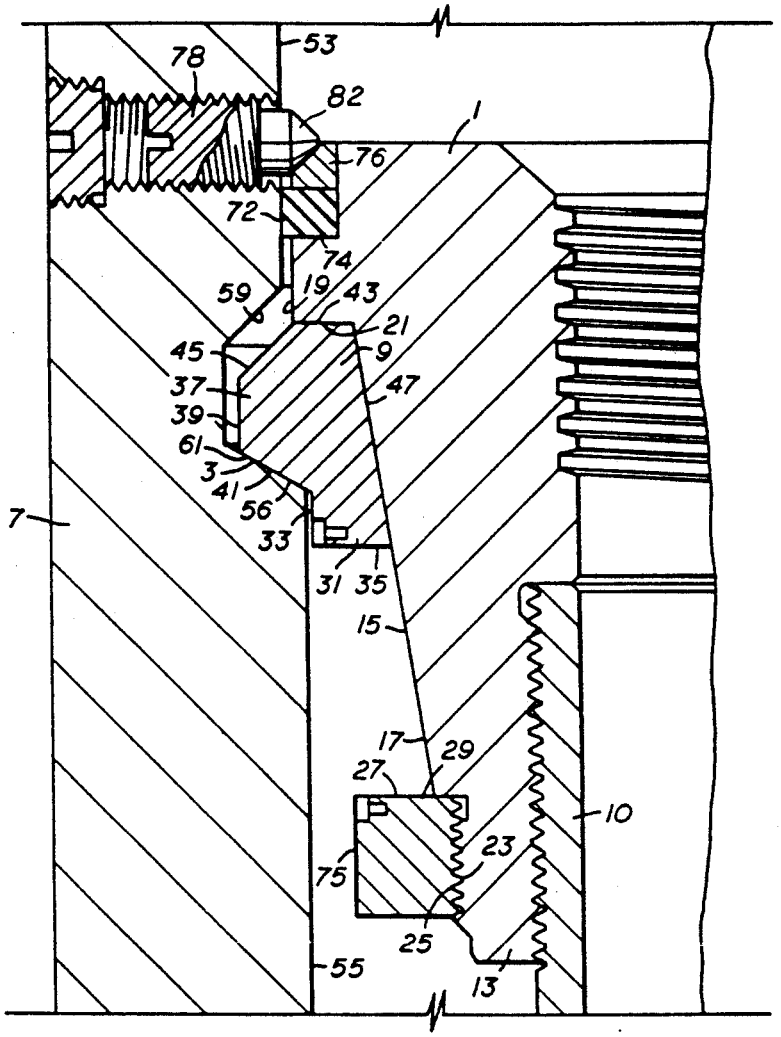
FIG. 2 is an enlarged, fragmentary cross-sectional view of one of the annular weight support members of FIG. 1 structural support member, through an expandable load ring according to the present invention.

Referring now to FIGS. 1 and 2, hanger 1 comprises an annular, generally circular cylindrical, tubular metal member, e.g., of steel, having an upper body portion 11 and a lower, reduced OD portion 13. Between upper body portion 11 and lower reduced OD portion 13, hanger 1 includes an intermediate, load ring actuating portion 15 having a downwardly facing, downwardly and inwardly tapering frustoconical camming surface 17 around its exterior periphery. Between the upper end of camming surface 17 and the exterior cylindrical wall surface 19 of upper body portion 11, there is disposed around hanger 1 a downwardly facing annular shoulder 21. A threaded pin or box may be provided on the lower terminal end of portion 13 of hanger i for connection to the box or pin end, as the case may be, of the uppermost joint of casing 10 of the string suspended from hanger 1.

The upper exterior periphery of reduced OD portion 13 of hanger 1 below camming surface 17 is provided with threads 23 for receiving a correlatively internally threaded, as at 25, annular retainer ring 27. Annular retainer ring 27 is a substantially solid-bodied element of steel or other material compatible with conventional wellhead equipment. Ring 27 may have a rectangular cross-sectional configuration as shown in the drawings, but other cross-sectional configurations may be alternatively employed. Ring 27 has an upper support surface, such as upper flat surface 29, on which load ring 9 rests when the hanger-load ringretainer ring assembly is made up and as it is lowered into the head 7.

Load ring 9 preferably comprises a substantially solidbodied, split annular metal element, e.g., of 4140 steel or other material compatible with conventional wellhead equipment. Load ring 9 preferably has a configuration which assumes a substantially complete, circular ring shape in its contracted or non-actuated state, which has been cut transversely in one location completely through the ring body. Load ring 9 is slidably mounted around intermediate portion 15 of hanger 1, and is retained thereon by retainer ring 27.

Load ring 9 includes a lower body portion 31 having a substantially circular cylindrical outer wall surface 33 and a substantially flat lower face 35. Above lower body portion 31, load ring 9 includes an outwardly extending flange portion 37 with a substantially circular cylindrical outer wall surface 39. Between cylindrical outer wall surfaces 33, 39 load ring 9 has a downwardly facing, downwardly and inwardly tapering, frustoconical load bearing surface 41. Load ring 9 further includes a substantially flat upper terminal end face 43, and an upwardly facing, upwardly and inwardly tapering, frustoconical release camming surface 45 between outer wall 39 of flange portion 37 and upper face 43. On the interior periphery of load ring 9, between upper end face 43 and lower end face 35, load ring 9 has an upwardly facing, downwardly and inwardly tapering, frustoconical actuating or camming surface 47. Surface 47 is shaped correlatively to and is slidably engaged by camming surface 17 of hanger 1 for actuating load ring 9 as described further below.

Head 7 includes as part of its interior bore 5 a substantially circular cylindrical bore wall 51 above load support groove 4; a reduced inner diameter, substantially circular cylindrical bore wall 53 between load support groove 3 and 4; and a reduced inner diameter, substantially circular cylindrical bore wall 55 below load support groove 3. The inner diameter of the bore of head is less at wall 53 than it is at wall 51, thereby forming an annular no-go shoulder 54 which protrudes into the bore 5 a distance equal to the difference in radii of wall surfaces 51, 53. Likewise, the inner diameter of the bore 5 of head 7 is less at wall 55 than it is at wall 53, thereby forming a second annular no-go shoulder 56. A protrusion of about one-eighth inch for shoulder 56 beyond the profile of wall 53 should be sufficient for beginning actuation of load ring 9 as described further below.

Load support groove 3 includes a substantially circular cylindrical end wall surface 57, an upper wall surface or roof 59 between the upper edge of end wall surface 57 and wall 53, and a load support surface 61 between the lower edge of end wall surface 57 and wall 55. Upper wall surface 59 is a downwardly facing, upwardly and inwardly tapering, frustoconical release camming surface which is shaped correlatively to surface 45 of load ring 9. Load support surface 61 is an upwardly facing, downwardly and inwardly tapering, frustoconical surface which is contiguous with and includes no-go shoulder 56, and is shaped correlatively to surface 41 of load ring 9.

Figure 3:
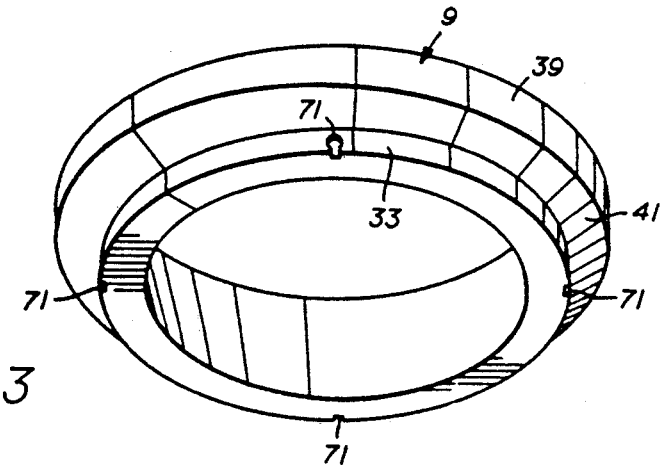
FIG. 3 is an isometric view, taken from below, of one of the expandable load rings shown in FIG. 1.
Figure 4:
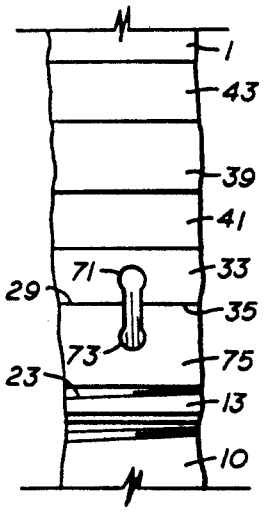
FIG. 4 is a fragmentary elevational view of a load ring and retainer ring prior to expansion of the load ring to support the casing hanger.

Referring to FIGS. 3 and 4, load ring 9 includes a plurality, e.g. four, of recesses 71 circumferentially spaced apart about its lower outer periphery in cylindrical wall surface 33. When load ring 9 is made up on hanger 1 and retainer ring 27 is threaded onto the hanger behind it, the load ring rests atop the retainer ring with surface 35 of ring 9 supported on surface 29 of ring 27. Load ring 9 will be in its contracted or non-actuated state. Retainer ring 27 is provided with a plurality, e.g. four, of recesses 73 (only one shown) circumferentially spaced apart about its upper outer periphery in circular cylindrical wall surface 75. Each of the recesses 71 is in register with one of the recesses 73 when the load ring is resting atop the retainer ring. A preferably dumbbell-shaped, fracturable cupon (not shown) is disposed between rings 9, 27 in each pair of recesses 71, 73 and is retained therein by friction. The fracturable cupons prevent the load ring 9 from sliding axially upwardly on the hanger, away from the retainer ring, until they are fractured by a predetermined load applied to the cupons through the load ring by the weight of the casing string after the load ring has engaged the no-go shoulder 56. After the cupons have been fractured, the load ring is free to slide upwardly with respect to the hanger, which is effected by the hanger's moving downwardly in the head while the load ring remains stationary on shoulder 56.

Alternatively, load ring 9 may be prevented from moving upwardly with respect to the hanger until a predetermined load has been applied by the casing weight, by a single fracturable cupon disposed in registering recesses in the facing free ends of the load ring, i.e., at the location of the cut. In the event such a single cupon were to be used, there would be no need for any recesses 73 in retainer ring 27. Such a single fracturable cupon would prevent the separation of the free ends of load ring 9, and thereby expansion of the load ring and travel upwardly with respect to the hanger, until fractured by the predetermined casing weight load. Again, after the cupon is fractured, the load ring is free to slide upwardly with respect to the hanger. It should be understood that the load applied to such a single cupon in order to fracture it is that load which is tending to separate the free ends of the load ring, which results from the outwardly directed camming action of surface 17 against surface 47. Due to friction losses, it will probably require more casing weight load to fracture a single cupon disposed between the load ring ends than several of the same size cupons disposed between the load ring and retainer ring.

The fracturable cupons employed in the present invention may be made of bronze, aluminum, or other suitable metal, and may have any suitable shape, such as bone-shaped, dovetailed, I-shaped, or the like, as an alternative to the dumbbell-shaped cupons discussed above. The only requirements are that the cupons remain in place in their recesses during lowering of the hanger into a position in the head whereby the load ring lands on shoulder 56, and that they not fracture until the proper, predetermined load, e.g., a load in the range of about 15,000 lbs., is applied to them by the casing weight after such landing. Alternative means for effecting the results achieved by the cupons may be used, such as wiring the free ends of the load ring together with wire of predetermined strength placed through adjoining anchor holes in the load ring ends. Other equivalent means for preventing premature actuation of load ring 9 will be apparent to those skilled in the art.

In operation, load ring 9 is inserted over the lower end of hanger 1 onto intermediate body portion 15. Retainer ring 27 is then inserted over that same end, threaded connection 23, 25 made up, and the fracturable cupon or cupons, or other appropriate retaining means such as wire binding, installed to prevent premature actuation of the load ring. Hanger 1 with its casing string attached is lowered into head 7 until the radially outermost portion of frustoconical surface 41 of load ring 9 engages and lands upon no-go shoulder 56. It should be noted that in the running in position, with load ring 9 disposed on retainer ring 27, the outer cylindrical wall 39 of load ring 9 does not extend radially outwardly beyond upper cylindrical wall 19 of hanger 1, thereby permitting the load ring 9 to pass downwardly through bores 51, 53 of head 7. With load ring 9 in its running in position, wall 39 does protrude radially outwardly a sufficient distance, however, to interfere with no-go shoulder 56.

After load ring 9 lands on shoulder 56, when the predetermined fracture load has been applied by the casing weight to the cupon or cupons through the load ring, the cupon or cupons fracture, and continued downward movement of the hanger with respect to the load ring cams the load ring radially outwardly, fully onto support surface 61. When annular stop shoulder 21 of hanger 1 engages upper face 43 of load ring 9, downward movement of the hanger stops, and the hanger 1 and casing string 10 attached thereto are suspended from shoulder 61 of groove 3. There is sufficient bearing area between shoulder 61 and surface 41 to support the weight of hanger 1 and the casing string attached thereto, and also the loads applied to hanger 1 by any internal wellhead pressures. The casing string may then be cemented and packed off to complete the setting of that string prior to continued drilling operations and running and setting of the next smaller size of casing. An annular seal member 72 of rubber or other suitable elastomer is disposed on a shoulder 74 around the upper body portion 11 of hanger 1. An actuating ring 76 is disposed on top of seal member 72, and has a chamfered surface around its upper outer periphery for engagement by a hold down screw or lock screw 78. Lock screw 78 has a conicalshaped nose 82 which, when the lock screw is tightened, forces the actuating ring downwardly into actuating engagement with the seal member 72. The conical-shaped nose 82 cams the actuating ring downwardly, when the lock screw is tightened, by engaging the chamfered surface of the actuating ring. When the actuating ring is forced downwardly, the seal member 72 is squeezed such that it expands into sealing engagement with the wall 52 of hanger 1.

Referring again to FIG. 1, it can thus be seen that with the present invention, a suitable load shoulder for hanger 1 and its attached casing 10 may be run through the relatively restricted bores 51, 53 of head 7, and hence through a similarly restricted bore through the BOP stack mounted above head 7. Another recessed load support groove 4 may be provided in the wall 51 of head 7 above groove 3, for supporting the next smaller size casing string. Wall surface 53 may comprise the no-go shoulder for such additional load support groove 4. Hanger 2 with casing 12 attached is lowered into the wellhead such that casing 12 is received within casing 10. It should be understood that a third and subsequent load support grooves, e.g., groove 80, may likewise be added above the second groove 4, with the cylindrical bore wall surface of head 7 above each groove serving as the no-go shoulder for the next higher groove. The next smaller size casing hanger, which will be suspended from groove 80, is indicated in phantom lines in FIG. 1. It is believed that six or more casing strings may easily be accommodated in a casing head constructed in accordance with the present invention. It will be apparent to those skilled in the art that such a plurality of casing strings may be run and set with the present invention without removal of the BOP stack between strings, and without any special tools to actuate the load rings. The load rings are actuated by casing weight alone. If it were necessary to remove hanger 1 from head 7 after load ring 9 has been actuated, the hanger is simply lifted straight up. Since load ring 9 is expanded into full engagement with groove 3 while remaining within its elastic limits, ring 9 will collapse back into its contracted state when surface 17 is backed away from surface 47 as hanger 1 is lifted. Should there be some resistance in ring 9 collapsing into its retracted state such that it tends to rise in groove 3 as hanger 1 is raised, the engagement of surface 45 against surface 59 of head 7 will cam ring 9 back into contraction. In addition, the chamfer provided by tapered surface 45 of load ring 9 assists in raising the load ring past any obstructions in the BOP stack, since it helps the load ring bounce or deflect away from any such obstructions.

Although the present invention is particularly useful for hanging a plurality of casing strings from a single head, it should be understood that its utility is not limited to that. Other uses of the expanding load shoulder and recessed load support groove of the present invention will be apparent to those skilled in the art. For example, and not by way of limitation, the present invention may be incorporated in a test plug mounted between the BOP stack and the casing hanger for testing the BOP stack. The loads applied in pressure testing the BOP stack are greater than those which can be accommodated by conventional casing heads, but the expanding load shoulder of the present invention when incorporated in a test plug will be able to withstand such increased loads.

While preferred embodiments of the invention have been shown and described, many modifications thereof may be made by those skilled in the art without departing from the spirit of the invention. Accordingly, the scope of the invention should be determined in accordance with the following claims.

I claim:

1. A self-actuating, releasable weight support system, comprising:

a generally circular cylindrical structural support member having a central bore therethrough, said bore having an annular groove with a recessed load support surface therein and a no-go shoulder adjacent thereto;

a generally circular cylindrical weight support member insertable within said bore, said weight support member having an actuating portion with a tapered outer surface and an annular stop shoulder at the larger diameter end of said tapered outer surface;

an annular retainer ring attached to the smaller diameter end of said tapered outer surface;

an expandable split load ring slidably disposed on said weight support member between said retainer ring and said top shoulder and supported by said annular retainer ring when aid releasable weight support system is assembled, said load ring including landing means for landing on said no-go shoulder and tapered actuating surface means engageable with said tapered outer surface of aid actuating portion of said weight support member as said weight support member moves further into said bore, for camming and expanding said load ring onto said load support surface as said weight support member is inserted further into said bore;

shearable connection means disposed between said split load ring and said retainer ring for releasably connecting said split load ring to said retainer ring and for preventing the premature expansion of said split load ring in said bore prior to said load ring landing on said no-go shoulder, said shearable connection means including actuation means responsive to the weight of said weight support member applied to said split load ring after landing on said no-go shoulder for causing said shearable means to shear for separating said split load ring from said retainer ring, and wherein further movement of said weight support member into said bore causes said tapered actuating surface means of said split load ring to further engage with and slide along said tapered surface of said weight support member until said split load ring abuttingly engages said annular stop shoulder, said annular stop shoulder including means engageable with said load ring for supporting said weight support member on said load ring and preventing further travel of said weight support member past said groove when said split road ring is fully cammed onto said groove.

2. Apparatus of claim 1, wherein said split load ring is a C-shaped, substantially annular member which is expandable into fully actuated position on said load supported surface within the elastic limits of said load ring means.

3. Apparatus of claim 2, wherein the ends of the C-shaped split load ring are disposed closely adjacent one another, forming a substantially closed annular member, prior to actuation.

4. Apparatus of claim 1, wherein said split load ring has a frustoconical surface around its inner periphery, shaped correlatively to said tapered surface of said actuating portion of said weight support member, said frustoconical surface and said tapered surface coacting to cam said split load ring outwardly onto said groove when said weight support member is inserted further into said bore.

5. Apparatus of claim 1, wherein said split load ring further includes a frustoconical upper outer surface, and said groove includes a frustoconical upper shoulder shaped correlatively to said frustoconical upper outer surface of said split load ring for camming said split load ring back into a non-actuated position when said split load ring is removed, with said weight support member, from said bore.

6. Apparatus of claim 1, wherein said shearable means includes at least one fracturable cupon disposed between said split load ring and said retainer ring prior to actuation of said split load ring.

7. Apparatus of claim 1, wherein said split load ring, includes shearable means disposed between its free ends at said split for preventing the premature expansion of said split load ring in said bore, and the weight of said weight support member on said split load ring after landing on said no-go shoulder causing said shearable means to shear, permitting expansion of said split load ring, further movement of said weight support member into said bore causing said split load ring to slide along said tapered surface until said split load ring interferingly engages said annular stop shoulder, preventing further travel of said weight support member past said groove.

8. Apparatus of claim 1, wherein the upper outer surface of said split load ring and the upper surface of said groove are frustoconical and correlatively shaped, and movement of said weight support member out of said bore causes the frustoconical upper outer surface of said split load ring to engage to correlatively shaped surface of said groove, camming and split load ring out of said groove and causing said split load ring to slide along said tapered surface, collapsing into a non-actuated state, until said split load ring engages said retainer ring, further movement of said weight support member out of said bore carrying said split load ring out of said bore supported on said retainer ring.

9. A casing head and hanger apparatus for suspending multiple casing strings from the head in an oil or gas well, comprising:

a head member having a generally circular cylindrical bore therethrough;

a first recessed annular load support groove in the wall of said bore, said bore below said groove forming a first restricted inner diameter area comprising a first annular no-go stop shoulder;

a first hanger for suspending casing therefrom, said hanger carrying a first expandable load ring including means engageable with said no-go stop shoulder for expanding said load ring into said first groove upon actuation of said expanding means by landing said first expandable load ring on said first no-go stop shoulder and continued downward movement of said first hanger;

a second recessed annular load support groove in the wall of said bore disposed above said first recessed annular load support groove, said bore wall between said first and second grooves having a greater internal diameter than said first no-go stop shoulder and forming a second restricted inner diameter area comprising a second annular no-go stop shoulder for said second groove;

a second hanger for suspending casing therefrom within the casing suspended from said first hanger, said second hanger carrying a second expandable load ring including means engageable with said second no-go stop shoulder for expanding said second load ring into said second groove upon actuation of said expanding means by landing aid second expandable load ring on said second no-go stop shoulder and continued downward movement of said second hanger; and the bore wall above said second groove having a greater internal diameter than said second no-go stop shoulder.

10. Apparatus of claim 9, wherein said first no-go shoulder extends into said bore about ⅛ inch beyond said second no-go shoulder, and said second no-go shoulder extends into the said bore about ⅛ inch beyond said bore wall above said second groove.

11. Apparatus of claim 10, and further including a third recessed annular load support groove in the wall of said bore above said second recessed annular load support groove, said bore wall between said second and third grooves comprising a third no-go shoulder for said third groove, said bore wall above said third groove being stepped back about ⅛ inch from said third no-go shoulder, and including a third hanger for suspending casing therefrom with the casing suspended from said second hanger, said third hanger carrying a third expandable load ring for expanding into said third groove upon actuation by landing said third expandable load ring on said third no-go shoulder and downward movement of said third hanger.

* * * * *